United States Patent [19]

Moroco et al.

[11] 4,119,302

[45] Oct. 10, 1978

[54] OBJECT SUPPORTS

[76] Inventors: Philip A. Moroco, 710 S. Buhl Farm Dr., Sharon, Pa. 16146; Gaylord T. Brow, Bosler Rte., Bosler, Wyo. 82051

[21] Appl. No.: 786,124

[22] Filed: Apr. 11, 1977

[51] Int. Cl.[2] ..... B21F 27/00

[52] U.S. Cl. ..... 256/48; 52/364; 256/DIG. 5

[58] Field of Search ..... 256/48, DIG. 5; 52/364; 85/49

[56] References Cited

U.S. PATENT DOCUMENTS

| | | | |
|---|---|---|---|
| 1,202,988 | 10/1916 | Freeze | 85/49 |
| 1,477,349 | 12/1923 | Hindmarsh et al. | 52/720 |
| 1,964,404 | 6/1934 | Lynch | 256/48 |
| 2,067,359 | 1/1937 | Tumminello | 85/49 |
| 2,457,250 | 12/1948 | Macomber | 52/364 |
| 3,023,660 | 3/1962 | Brown | 85/49 |
| 3,282,005 | 11/1966 | Birdwell | 52/364 |
| 3,332,189 | 7/1967 | Blatnik | 52/364 |

*Primary Examiner*—Andrew V. Kundrat
*Attorney, Agent, or Firm*—Michael Williams

[57] ABSTRACT

The invention comprises the combination of a metal post and staple means for securing an object to the post. The object is preferably a wire barrier, such as a barbed wire, although it may take the form of a roadside sign or highway marker. The post has a Vee cross-section and a metal staple is driven into the Vee to interengage with post surfaces at the opening into the Vee. A portion of the secured object is contained within the bight portion of the staple, and in the case of a wire, the latter extends through the bight portion of the staple and is held securely to the post.

2 Claims, 7 Drawing Figures

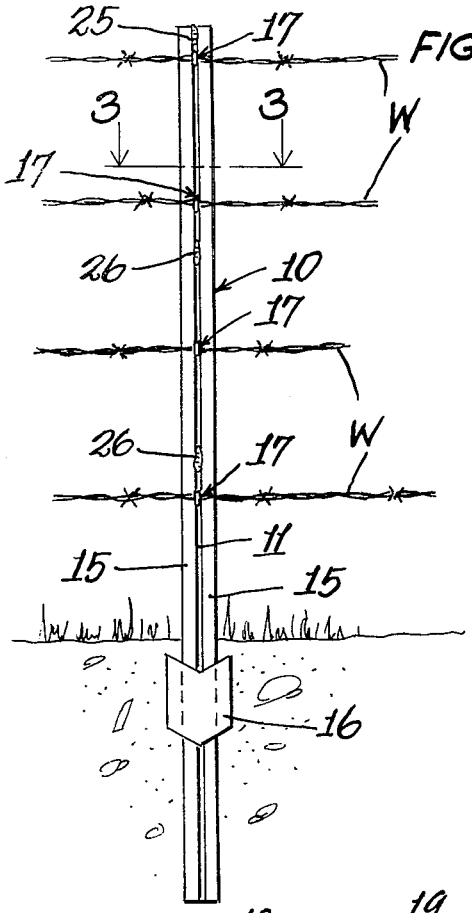
FIG. 1.
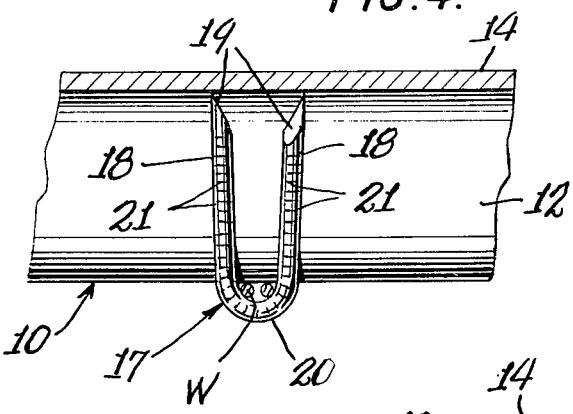
FIG. 4.
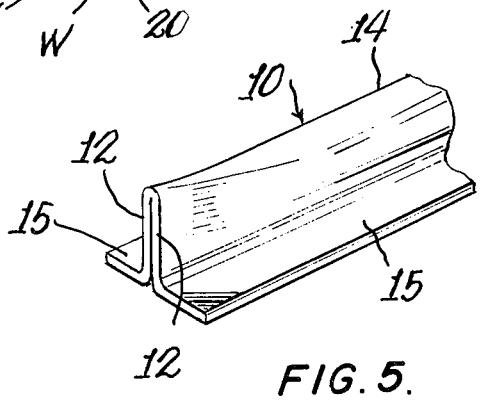
FIG. 5.
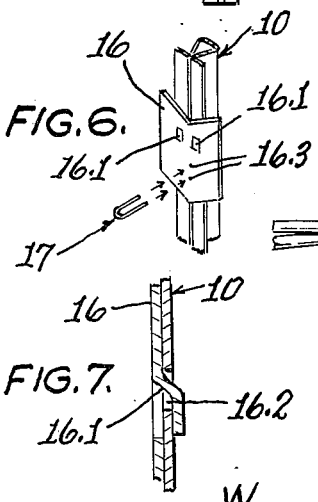
FIG. 6.
FIG. 7.
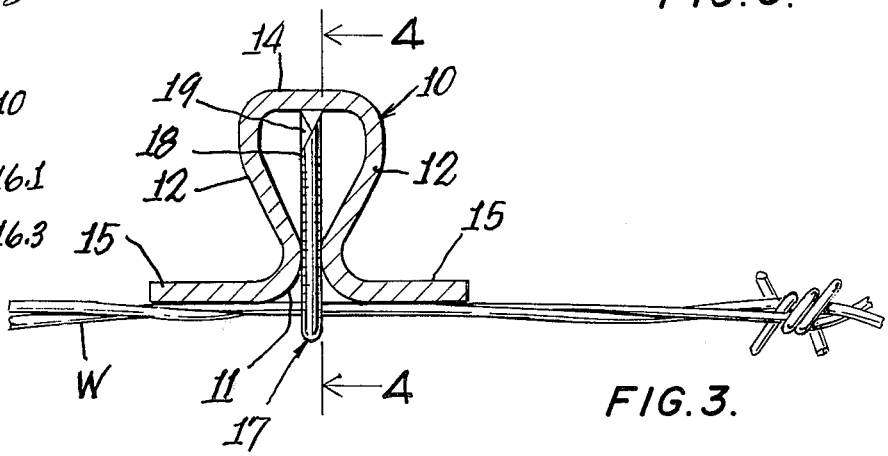
FIG. 3.
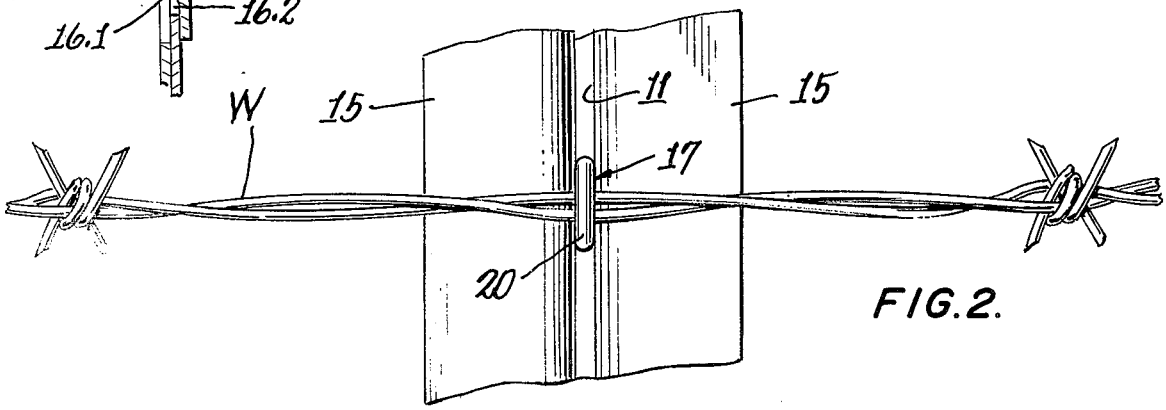
FIG. 2.

OBJECT SUPPORTS

BACKGROUND AND SUMMARY

Our invention is particularly useful in forming a barrier, either in the form of a corral for animals, such as cattle, or in the form of a line fence, and may support wires, such as barbed wires, or a chain link fence. Our invention is also adapted for the purpose of supporting signs or highway markers.

Insofar as is presently known, metal fence posts, usually of Tee cross-section, have previously been driven into the ground in spaced relation and the strung wire to form the fence was tied to each post by a short piece of tie wire that was twisted around the post and the strung wire. When cattle pushed against a post or against the strung wire, the twisted wire would loosen and in time the tie connection would become so loose as to permit the strung wire to gradually move downward until it no longer formed an effective corral. This prior type of connection was also unreliable in hilly country, where certain posts were on a hill and connected by the strung wire to posts at lower elevations. The tautness of the strung wire between such posts exerted a force to pull the strung wire downwardly on the post on the hill, and the wires in many cases could not prevent this undesirable action. In case of signs or highway markers, they were usually attached to a single post by screws or nuts and bolts, which required tools and time to install. In contrast, any striking instrument, such as a hammer, is only needed to drive a staple in sign-holding position.

Our invention also eliminates the need for tie wires of the prior art and provides a fastening for the strung wire that overcomes the disadvantages above mentioned. In summary, our invention utilizes a metal post that is of Vee cross-section, and a staple, the staple legs being driven into the Vee of the post to firmly grip with the post surfaces defining the opening into the Vee. Welds may be made on each post to insure uniformity of the size of the Vee opening, and to prevent the Vee from opening by forces exerted by the cattle, or the driving force used in seating the staples.

DESCRIPTION OF THE DRAWINGS

In the drawings accompanying this specification and forming a part of this application, there is shown, for purpose of illustration, one embodiment of our invention, and in these drawings:

FIG. 1 is a face view of a fence post which has been driven into the ground, and showing four stretches of barbed wire attached thereto, FIG. 2 is an enlarged, fragmentary view of a portion of the fence post shown in FIG. 1, FIG. 3 is an enlarged, transverse section, corresponding to the line 3—3 of FIG. 1, FIG. 4 is a fragmentary, sectional view corresponding to the line 4—4 of FIG. 3, FIG. 5 is a fragmentary perspective view of the lower end of the fence post, FIG. 6 is a fragmentary perspective view, drawn to a reduced scale, to illustrate two variations of the preferred embodiment, namely, a detachable ground plate and a method of attaching a sign to a single post, and FIG. 7 is an enlarged, fragmentary sectional view showing how the ground plate is detachably connected to the post.

DESCRIPTION OF THE PREFERRED EMBODIMENT

Our invention incorporates an elongated metal post 10 which has a Vee cross-section as seen in FIG. 3, to provide a throat portion having a relatively narrow opening 11 which extends substantially the entire length of the post. The opening is formed by converging legs 12—12 which are joined by a bight portion 14. Preferably, although not necessarily, each of the legs 12 has an angularly related flat flange 15 intergral with and extending outwardly therefrom. The flat flanges also extend for the entire length of the post. The post may be formed of a flat strip of metal which is roll-formed in conventional manner.

A flat metal ground plate 16 may be welded across the flanges 15—15 near a lower portion of the post. The post is driven into the ground, as shown in FIG. 1, so that the plate 16 is just below the ground surface so that it offers resistance to any tilting of the post which might be caused by cattle pushing against the post, or against the wires supported by the latter. Entry of the post into the ground in facilitated by a flat end as shown in FIG. 5. In some cases, the plate 16 may be omitted since in many installations, the portions of the flat flanges 15 within the ground offer sufficient resistance to tilting. In order to provide choice in the use of the ground plate 16, the latter may be detachably connected to the post. As seen in FIGS. 6 and 7, the plate has a pair of lanced portions 16.1 which are displaced rearwardly so that they may be seated within corresponding openings 16.2 formed in the flanges 15 of the post.

A conventional metal staple 17 is used to hold a stretch of wire or other object to the post 11. The staple is formed of metal rod of substantial cross-section, and includes a pair of legs 18—18, preferably having pointed ends 19—19. The legs 18 are joined by a bight portion 20, and the legs and bight may have serrations 21 formed thereon.

To secure a stretch of wire to a post 11, it is merely necessary to position a staple 17 with the wire running between its legs, and to drive the staple into the throat opening 11 until the bight portion 20 of the staple firmly clamps the wire across the flat flanges 15—15 of the post, as seen in FIG. 3. The staple is of a cross-section relative to the width of the throat opening 11 so that it firmly grips the surfaces defining the throat opening when the staple is driven home. The points 19 on the legs 18 provide for easy and accurate alignment of the legs with the throat opening, and the serrations 21, if used, grip the throat opening surfaces to resist outward movement of the staple from the throat.

In order to maintain uniformity in the width of the throat opening throughout its wire-supporting length, and to prevent the throat from opening beyond a predetermined width during the time it is pounded into the ground, or by action of cattle pushing against the post or stretched wires, a tack weld 25 is made at the top of the post. If necessary, further tack welds 26 may be made at spaced intervals. The flat plate 16, when welded to the post, may be considered as performing the function of a tack weld 26.

FIG. 1 shows four stretches of barbed wire W, each connected to the post 11 by a staple 17. It will be appreciated more or less stretches of wire may be so connected, depending upon requirements. Instead of the wire W, a chain link fence may be connected to the posts, by staples which engage with link portions aligned with the posts.

As seen in FIG. 6, a roadside sign or highway marker may be attached to a single post 10. In this case, the flat plate 16 should be considered as illustrative of a sign or highway marker of a suitable size and adapted to be secured to the post a desired distance above ground level. The plate has a pair of openings 16.3 formed therein to pass the legs of the staple 17 so that such legs may be driven into the throat 11 of the post.

We claim:

1. An object support, comprising:

a metal post adapted to have its lower end driven into the ground, said post having a Vee section of a form to provide spaced legs joined by a bight and converging to form a narrow throat opening of substantially uniform size throughout the length of the post adapted to extend above the ground, each leg having an integrally joined flat flange extending in a direction away from said throat opening and devoid of any portions overlapping the latter so as to provide free access to the same, a U-shaped metal staple having a pair of legs joined by a bight, each of said legs being round in cross-section for maximum strength in a lateral direction, said staple legs having a diameter larger than the size of said throat opening for drive fit into the latter and each having a pointed end adapted to loosely fit directly into said throat opening to align said staple legs with said throat opening for said drive fit, each of said staple legs having serrations therealong to grip with surfaces defining said throat opening and thereby resist movement of said staple outwardly of the latter, and said post having spaced welds joining said converging legs at said throat opening to resist spreading of said converging legs when a staple is driven into said throat opening and thereby preventing the loosening of staples already driven into said throat opening, a said staple when driven into said throat opening being adapted to clamp an object between its bight and said flat flanges, and wherein said post legs are flattened to abut each other at the lower end of said post to provide a pointed lower end to facilitate the driving of the post into the ground.

2. The construction according to claim 1 and further including a flat metal ground plate connected to the lower end of said post above said pointed post end, the connection between said ground plate and said post comprising lanced portions of said plate fitting within openings in said flat flanges, whereby said ground plate has detachable connection with said post so that it may be selectively connected or omitted.

* * * * *